US005577878A

United States Patent [19]

Brown

[11] Patent Number: 5,577,878

[45] Date of Patent: Nov. 26, 1996

[54] WORK MACHINE

[75] Inventor: David J. B. Brown, North Yorkshire, United Kingdom

[73] Assignee: Caterpillar Inc., Peoria, Ill.

[21] Appl. No.: 432,275

[22] Filed: May 1, 1995

[30] Foreign Application Priority Data

May 4, 1994 [GB] United Kingdom ..... 9408781

[51] Int. Cl.[6] ..... B66C 23/04

[52] U.S. Cl. ..... 414/708; 414/718; 414/917

[58] Field of Search ..... 414/700, 707, 414/708, 710, 718, 728, 917

[56] References Cited

U.S. PATENT DOCUMENTS

| | | | |
|---|---|---|---|
| 3,070,244 | 12/1962 | Lull | 414/707 |
| 3,792,786 | 2/1974 | Goikhburg et al. | 414/710 X |
| 3,952,890 | 4/1976 | Armstrong | 414/917 X |
| 4,218,171 | 8/1980 | Guinot | 414/707 X |
| 4,674,944 | 6/1987 | Addleman | 414/708 |
| 4,699,560 | 10/1987 | Ostermeyer et al. | 414/917 X |
| 4,822,237 | 4/1989 | Meyer et al. | 414/708 |
| 4,826,474 | 5/1989 | Holmes | 414/708 X |
| 4,964,778 | 10/1990 | Muto et al. | 414/708 X |
| 5,226,776 | 7/1993 | Vestergaard | 414/700 X |

FOREIGN PATENT DOCUMENTS

| | | | |
|---|---|---|---|
| 1434973 | 3/1966 | France | 414/708 |

*Primary Examiner*—David A. Bucci
*Attorney, Agent, or Firm*—Claude F. White

[57] ABSTRACT

A work machine includes a boom which is pivotally connected at one end to the machine and is provided at the other end with a tool carriage which is attached to the boom at a pivot which is fixed with respect to the boom. The tool carriage is associated with a mechanism for maintaining it at a constant attitude when the boom is raised and lowered. The boom further includes an extension for improving the versatility of the machine.

1 Claim, 6 Drawing Sheets

WORK MACHINE

TECHNICAL FIELD

The present invention relates to a work machine comprising a boom which is pivotally connected at one end to the machine body and is provided at the other end with a tool carriage attached to the boom at a pivot which is fixed with respect to the boom, the carriage being associated with a mechanism for keeping it at a constant attitude when the boom is raised and lowered. Such a machine is referred to as of the kind described.

BACKGROUND ART

If a load which is to be moved by such a work machine is to be picked up from or deposited at a location, for example, deep within a container or high above the machine, it is possible that the boom may not be long enough to reach the location.

DISCLOSURE OF THE INVENTION

According to the present invention a machine of the kind described is provided with an elongate boom extension comprising a parallelogram linkage having a pair of parallel links each pivotally connected at one end to a tool, a first one of the links being connected at its other end at or adjacent to the pivot of the tool carriage, and the second one of the links being pivotally connected to the tool carriage such that the tool follows the attitude of the tool carriage when the boom is raised and lowered.

By fitting the extension to the boom of the machine its operating range can be increased, thereby improving its versatility. Attaching the boom extension in this way allows an operator to control the angle of the tool on the extension as though it was a tool which is normally fitted to the carriage without the boom extension.

When the boom is raised and lowered, the first link does not follow the rotation of the carriage but rotates relatively to it. Thus, the other ends of the first and second links are moved relatively to one another thereby cranking the parallelogram linkage in such a way as to maintain the tool at a constant attitude. This arrangement ensures that the extension always remains substantially parallel to the boom, so that the bending moments on the boom are kept to a minimum.

To stabilize the parallelogram linkage, an additional link may be pivotally attached at one end to the tool, and at the other end to the boom at a location spaced from the carriage.

To improve the operating range of the boom, the boom is preferably telescopic.

An example of a work machine constructed in accordance with the present invention will now be described with reference to the accompanying drawings.

BEST MODE FOR CARRYING OUT THE INVENTION

Figure 1:
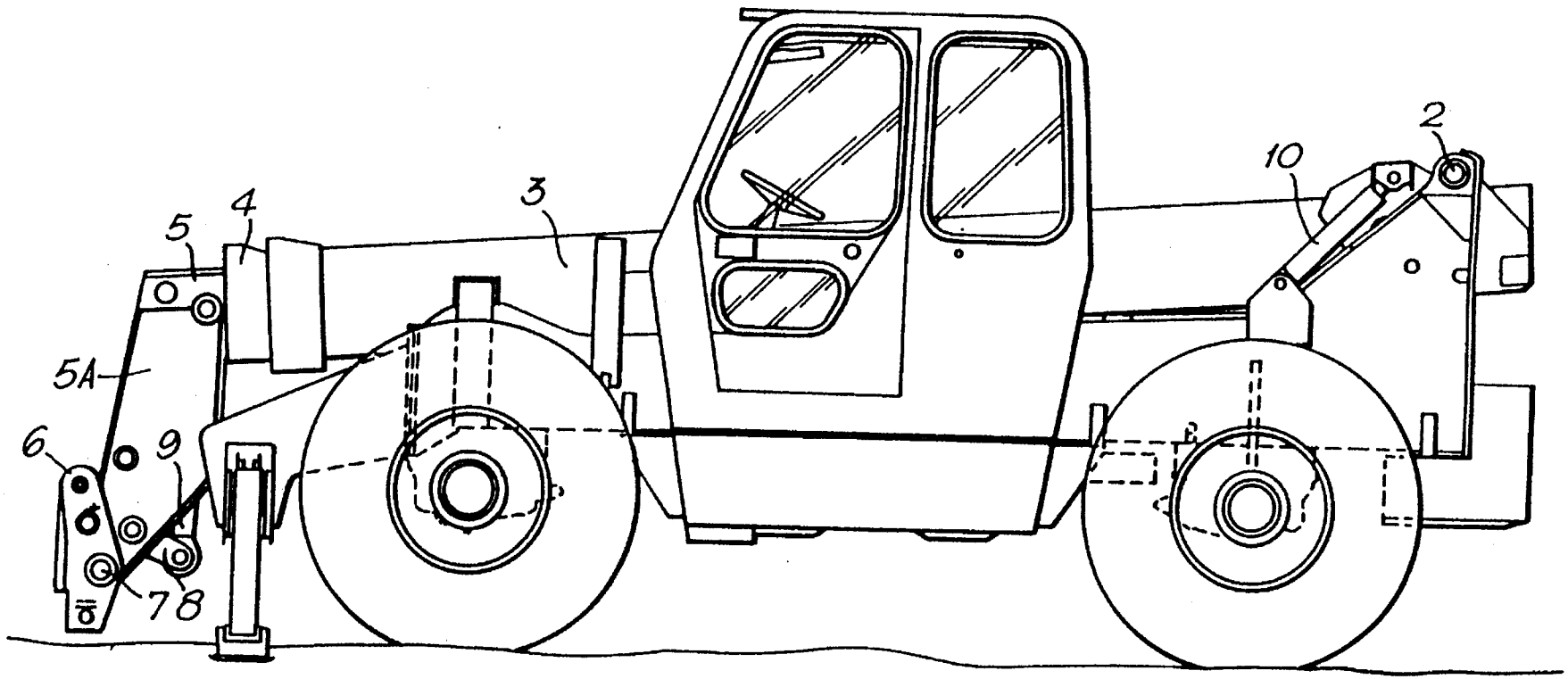
FIG. 1 is a side view of a machine to which a boom extension can be attached.

A machine to which the boom extension can be attached is shown in FIG. 1. The machine has a boom 1 which is pivotally mounted at a pivot 2 extending transversely to the longitudinal axis of the machine. The boom 1 comprises outer 3, intermediate 4 and inner 5 portions telescopically coupled together. The inner portion 5 has a depending bracket portion 5A. The inner portion 5 is provided at the extremity of the bracket portion 5A with a tool carriage 6 which is pivotally mounted to the bracket 5A at pivot 7. The angular position of the carriage 6 is adjustable via a linkage 8 which is pivotally connected at one end to the carriage 6 and at the other end to a hydraulic cylinder 9 which is pivotally mounted to the bracket portion 5A of the boom. This hydraulic cylinder 9 is hydraulically coupled by a rolling hose coiled within the boom 1 to a compensating hydraulic cylinder 10 which is positioned in such a way that the oil displaced from the compensating cylinder 10 when the boom is raised and lowered changes the length of the cylinder 9 and hence automatically adjusts the angle of the carriage 6. Thus, a conventional tool which is attached to the carriage can be kept at a constant attitude when the boom 1 is raised and lowered.

Figure 2:
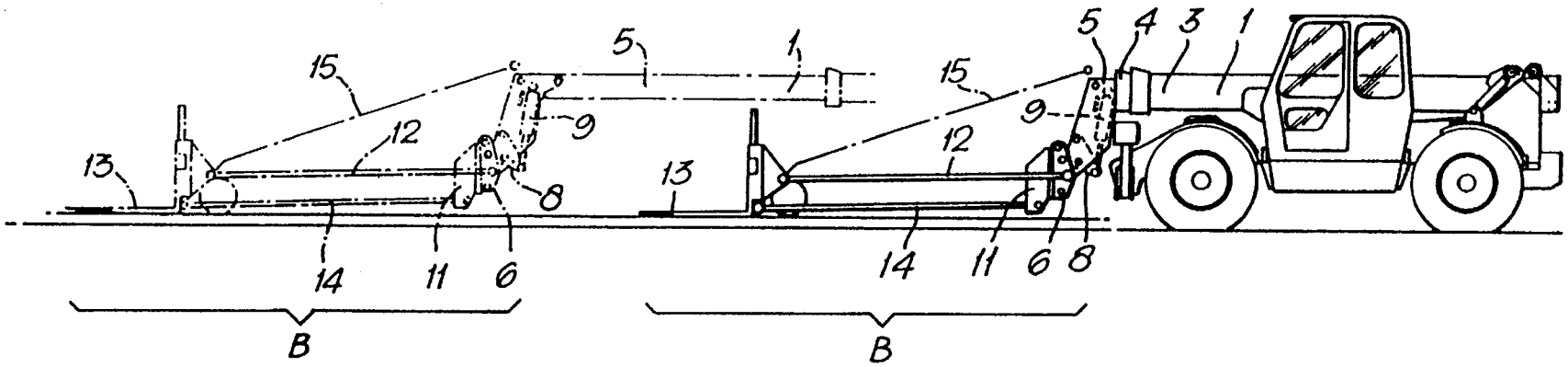
FIG. 2 is a somewhat diagrammatic side view of the machine showing the boom lowered in both telescopically extended and retracted configurations.
Figure 3:
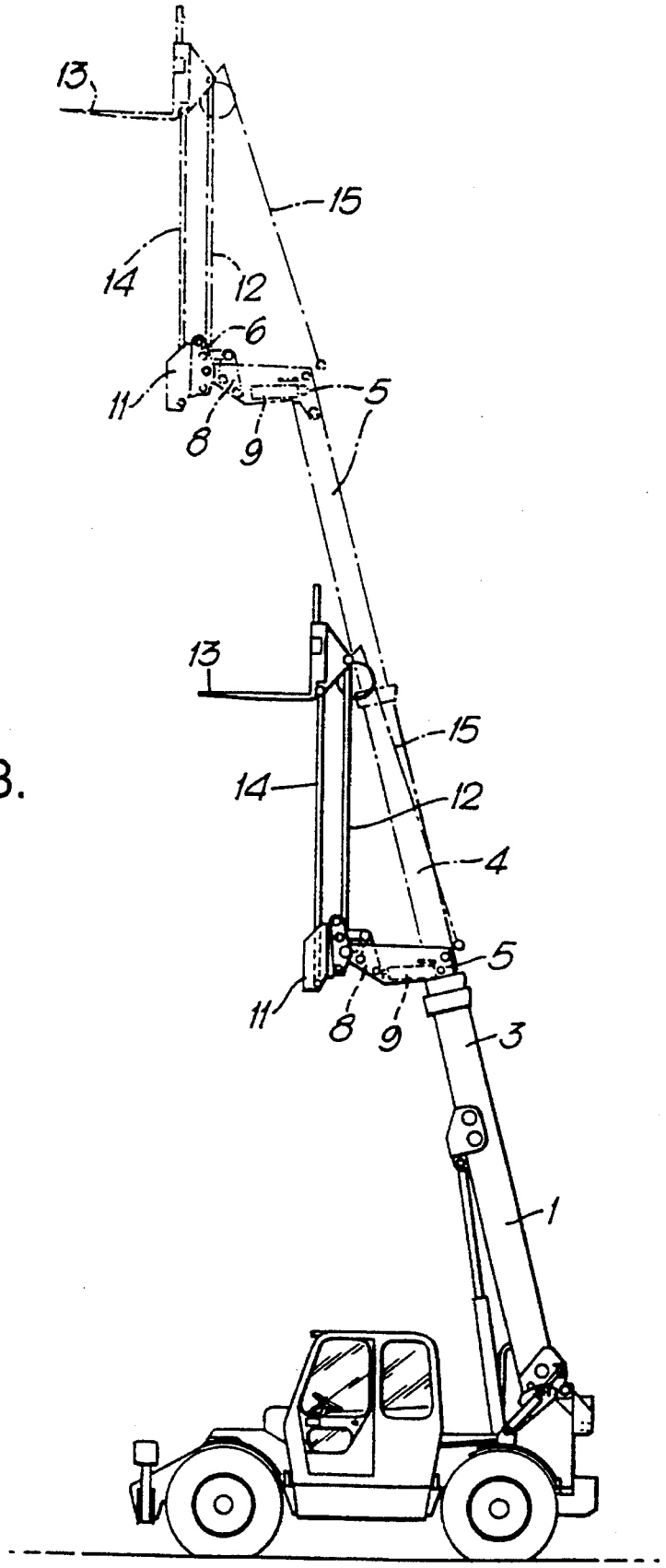
FIG. 3 is a side view of the machine showing the boom raised in both telescopically extended and retracted configurations.
Figure 4:
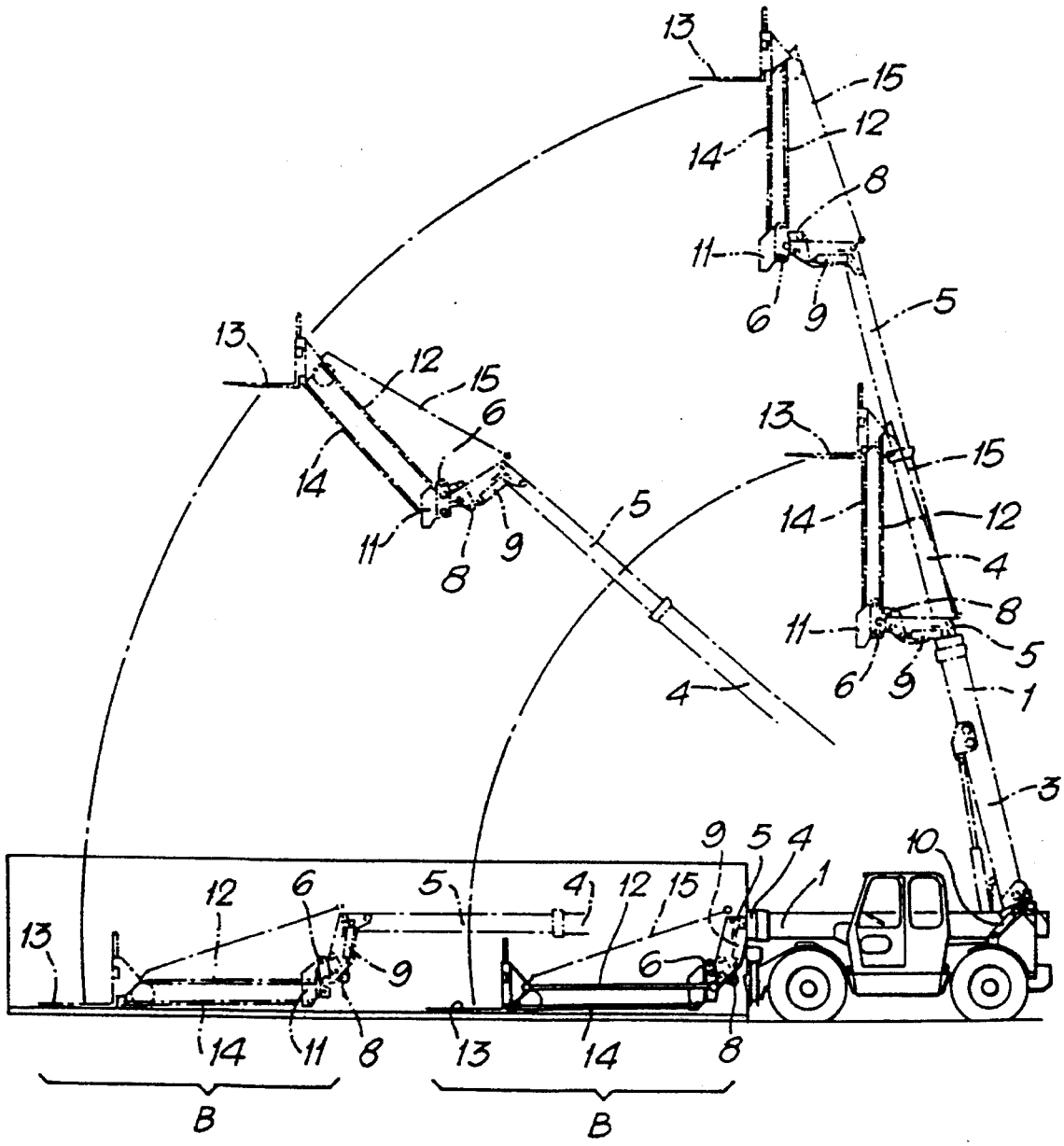
FIG. 4 is a side view of the machine showing the range of positions reachable by the tool using the boom extension.

When the range of operation of the boom is to be increased, the conventional tool which is normally mounted on the carriage 6 is removed and is replaced by a boom extension B as shown in FIGS. 2 to 4.

The boom extension B is provided at one end with an attachment 11 which is attached to the carriage 6 by a quick hitch device such that it does not rotate with respect to the carriage 6. At each side, a first link 12 is attached to the pivot 7 so that it can rotate relatively to the boom 1 and carriage 6. The opposite end of each first link 12 is pivotally connected to the conventional tool such as a fork 13. At each side a second link 14 is pivotally connected to the attachment 11 at one end and at the opposite end to the fork 13. The first 12 and second 14 links are the same length so as to provide a parallelogram linkage.

The parallelogram linkage is stabilized by a third link 15 which is pivotally connected at one end to the boom at a location remote from the carriage 6, and at the other end to the fork 13 at a position adjacent to the pivotal connection for the opposite end of the first link 12.

Figure 5:
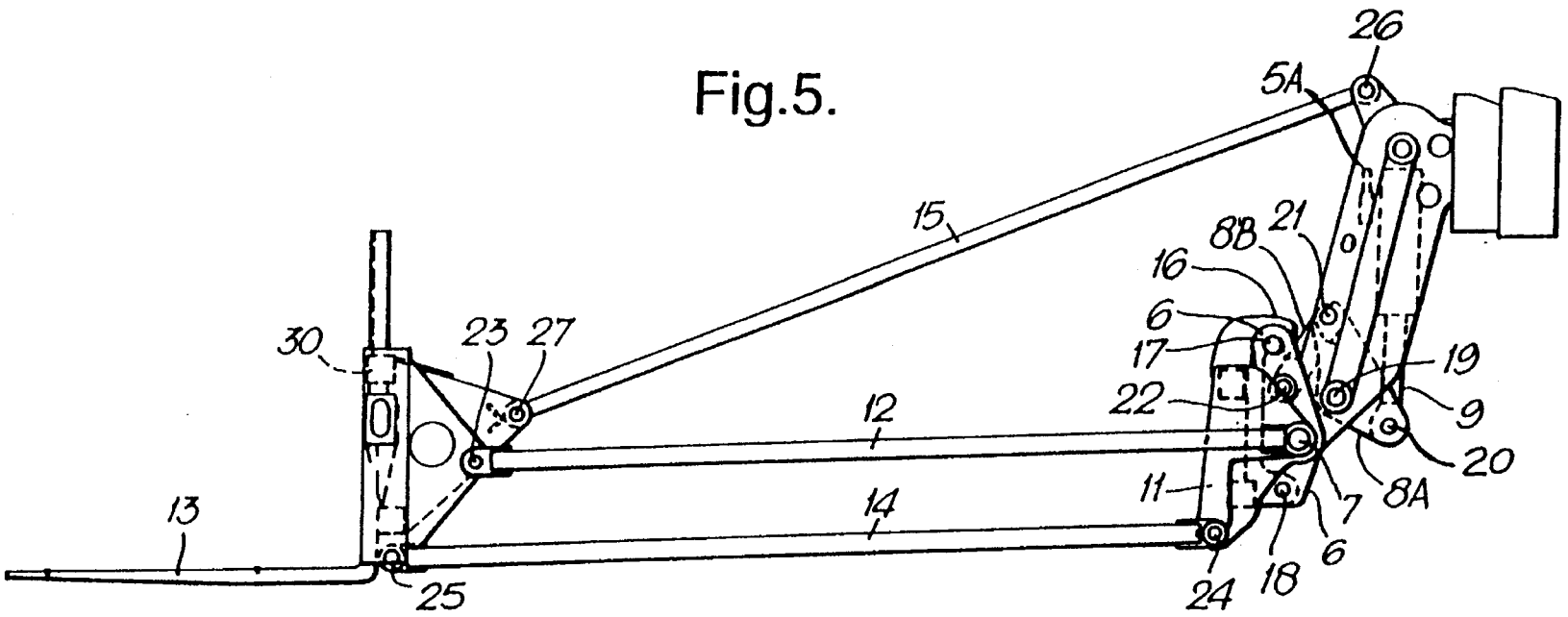
FIG. 5 is a side view of the boom extension in one position.
Figure 6:
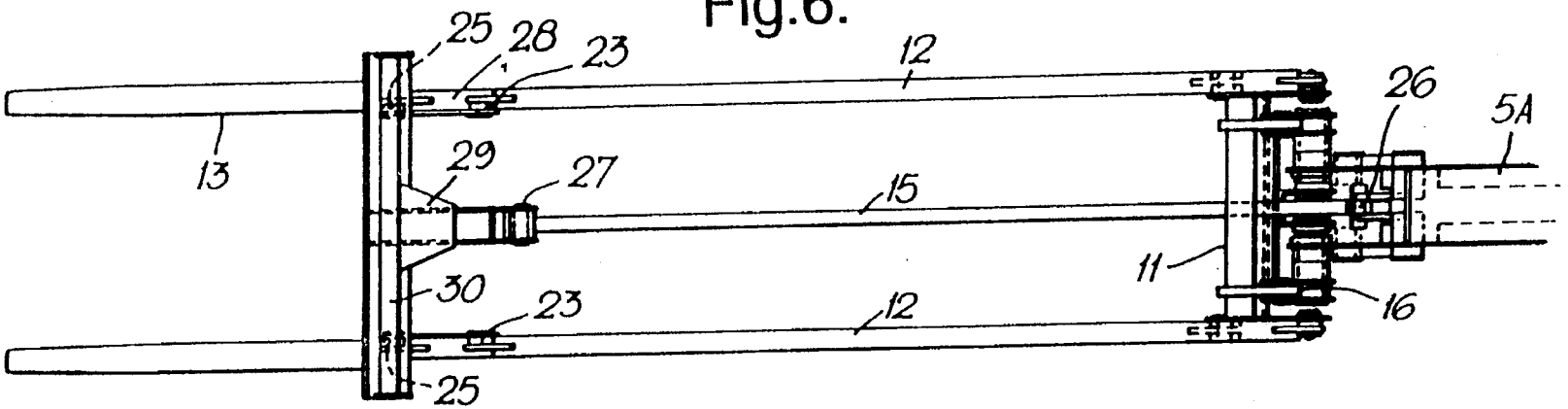
FIG. 6 is plan corresponding to FIG. 5.
Figure 7:
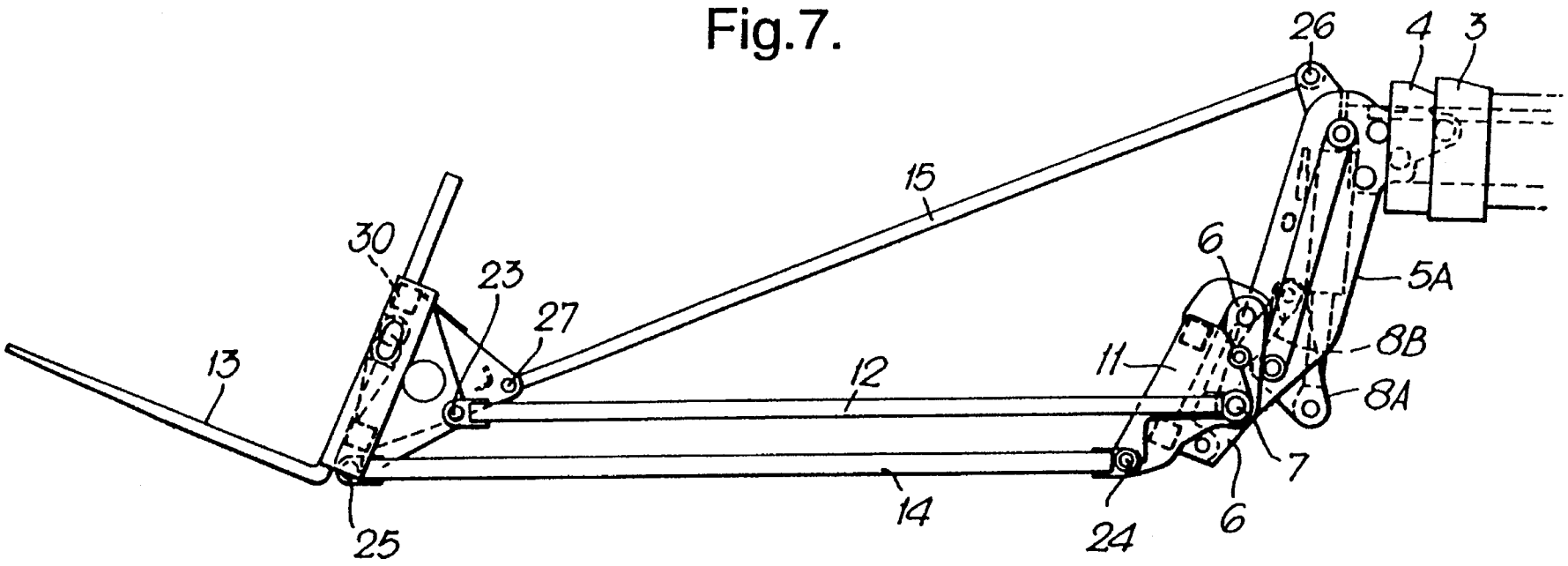
FIG. 7 is a view similar to FIG. 5, but showing another position.

The construction of the boom extension is shown in more detail in FIGS. 5 to 7. Thus the quick hitch device comprises a pair of hooks 16 which hook over respective pins 17 carried by the carriage 6. With these hooks engaged, pins 18 are inserted through aligned apertures in the attachment 11 and carriage 6 to secure the attachment to the carriage.

The linkage 8 interconnecting the hydraulic cylinder 9 with the carriage 6 comprises a bell crank 8A, which is pivoted at 19 to the bracket 5A and is pivoted at one end 20 to the ram and at its other end 21 to one end of a link 8B, the other end of which is pivoted at 22 to the carriage 6. It will thus be appreciated that as the ram 9 is extended, the bell crank 8A is caused to rotate in a clockwise direction as seen in FIGS. 5 and 7 thus closing the angle between the bell crank 8A and the link 8B and simultaneously rotating the carriage 6 and, when fitted, attachment 11, in a clockwise direction as seen in these figures. The fork or other tool 13 then follows this rotation by virtue of the parallelogram linkage 12,14 and FIG. 7 shows the fully extended position of the ram 9 in which the forks 13 are shown fully rolled back extending at 20° above the horizontal, with the boom extending horizontally. Similarly retraction of the ram 9 will rotate the parts in the anti-clockwise direction until the forks 13 are extending perpendicularly to the boom as shown in the right hand part of FIG. 4.

FIGS. 5 to 7 show the end pivots for the links 12,14 and 15 at 7 and 23,24 and 25, and 26 and 27, respectively. The pivots 23 and 25 are to webs 28, and the pivot 27 to a web 29, the webs 28 and 29 projecting from a back frame 30 of the fork tool.

INDUSTRIAL APPLICABILITY

In use, when the machine is fitted with the boom extension B, and the boom 1 is raised from the horizontal position shown in FIG. 2 to the elevated position shown in FIG. 3, the boom extension reacts as follows. The carriage 6 and attachment 11 are maintained at the same attitude while the first link 12 is rotated with respect to the carriage 6 and attachment 11. This cranks the parallelogram linkage round in such a way as to maintain the fork 13 at a constant attitude as shown in FIGS. 2 to 4.

If the controller of the machine wishes to adjust the angle of the fork 13, he does so in the same way as he would if a tool was attached directly to the carriage 6. Thus, a hydraulic force from the compensating cylinder 10 would adjust the length of hydraulic cylinder 9 which in turn rotates the carriage 6 causing the parallel linkage to rotate the fork 13.

The range of movement attainable by the tool is shown by envelope A in FIG. 4. The radially innermost corners of this envelope are those positions in which the boom 1 is fully telescopically retracted, and the radially outermost corners of the envelope are those in which the boom is telescopically fully extended.

In practice, when the boom 1 is raised from the horizontal position shown in FIG. 2 to the elevated position shown in FIG. 3, the boom will first be telescopically retracted before it is elevated, and will then be telescopically extended once it has reached its elevated position. This reduces the turning moment necessary to elevate the boom.

Other aspects, objects and advantages of this invention can be obtained from a study of the drawings, the disclosure and the appended claims.

I claim:

1. A work machine comprising a boom which is pivotally connected at one end of the machine body and is provided at the other end with a tool carriage attached to the boom at a pivot which is fixed with respect to the boom, the carriage being associated with a mechanism for keeping it at a constant attitude when the boom is raised and lowered, and an elongate boom extension including a parallelogram linkage having a pair of parallel links each pivotally connected at one end to a tool, a first one of the links being connected at its other end at or adjacent to the pivot of the tool carriage with the boom, the second one of the links being pivotally connected to the tool carriage such that the tool follows the attitude of the tool carriage when the boom is raised and lowered, and an additional link being pivotally attached at one end to the tool and at the other end to the boom at a location spaced from the carriage.

* * * * *